United States Patent [19]

Mandras et al.

[11] 4,030,680

[45] June 21, 1977

[54] AUTOMATIC DEVICE FOR SEIZING THE END OF A DRAWN PRODUCT FOR A DRUM OF A DRAWING BENCH

[75] Inventors: Christian Maurice Mandras; Carol Stanik, both of Revigny-sur-Ornain, France

[73] Assignee: Societe Metallurgique de Revigny, Revigny-sur-Ornain, France

[22] Filed: Aug. 18, 1976

[21] Appl. No.: 715,582

[30] Foreign Application Priority Data

Aug. 20, 1975 France ..... 75.25762

[52] U.S. Cl. ..... 242/78.3

[51] Int. Cl.[2] ..... B21C 17/10

[58] Field of Search ..... 242/78.3, 74, 74.1, 242/74.2, 125.1, 78.1

[56] References Cited

UNITED STATES PATENTS

| | | | |
|---|---|---|---|
| 2,951,657 | 9/1960 | Wallin | 242/74.1 X |
| 3,752,416 | 8/1973 | Fukatsu | 242/74 |
| 3,774,862 | 11/1973 | Rodach | 242/78.3 |

FOREIGN PATENTS OR APPLICATIONS

| | | | |
|---|---|---|---|
| 565,554 | 11/1944 | United Kingdom | 242/78.3 |

*Primary Examiner*—Edward J. McCarthy
*Attorney, Agent, or Firm*—Sughrue, Rothwell, Mion, Zinn & Macpeak

[57] ABSTRACT

An elongated lever pivotable on a drum for winding a drawn product, between an extended position and a withdrawn position in which it is withdrawn into a cavity in the drum and reconstitutes the wall of the drum, carries a drawn product end gripping mechanism pivotable on the lever. The cavity is upwardly inclined, relative to the direction of rotation of the drum about its axis, from the lower edge of the drum. The element is a cranked lever having a first arm having an elongated shape roughly corresponding to the shape of the cavity and a U-section and a second shorter arm extending inside the drum. The lever is mounted by its cranked portion in the upper end of the cavity to pivot about an axis oblique relative to the axis of the drum. The gripping mechanism is mounted between the branches of the U-section at the end of the first arm remote from the second arm to pivot in the plane of the first arm.

11 Claims, 6 Drawing Figures

AUTOMATIC DEVICE FOR SEIZING THE END OF A DRAWN PRODUCT FOR A DRUM OF A DRAWING BENCH

The present invention relates to an automatic product end seizing device for a winding drum of a drawing bench.

It is well known in the art that the seizing of the product end on a winding drum at the output end of a drawing bench is a difficult operation and that the means usually employed up to the present time are far from being satisfactory from the point of view of their efficiency and safety of the operators carrying out this operation.

A device for a drum of a drawing bench is disclosed in British Patent No. 515,554, in which the product end is fixed in a gripping mechanism which is pivotably mounted on one end of an arm which latter is pivotably mounted at its other end in a cavity provided in the drum, which cavity is capable of accomodating the arm.

However, in this device, the gripping mechanism must first be manually fixed to the product end and thereafter disposed on the end of the arm. This device does not avoid the manual operation for fixing the product end but merely avoids the utilisation of a length of cable or chain for starting the winding of the drawn product onto the drum.

An object of the invention is therefore to provide a simple device which may be mounted on a drum of a drawing bench of the aforementioned type and is adapted to automatically seize the end of the drawn product in an efficient and particularly reliable manner.

According to the invention, there is provided a device for automatically seizing an end of a drawn product for a drum of a drawing bench of the type comprising a gripping mechanism pivotably mounted on a movable portion of the wall of the drum constituted by an element of elongated shape pivotably mounted in a cavity of corresponding shape formed in the wall of the drum and adapted to move between an extended position, in which said gripping mechanism is roughly in alignment with the drawn product end, and a withdrawn position in which said element is returned to said cavity so as to approximately reconstitute the wall of the drum, wherein said cavity extends upwardly obliquely in the wall of the drum, with respect to the direction of rotation, from the lower edge of the drum, said element being a cranked lever having a first arm having an elongated shape roughly corresponding to the shape of said cavity and having a U-section constituting a fork whose intermediate portion closes said cavity in the withdrawn position, and a second shorter arm extending inside the drum, said lever being pivotably mounted by its cranked portion in the upper end of the cavity on an axis which is oblique with respect to the axis of the drum, the gripping mechanism being pivotably mounted between the branches of said fork at the end of the first arm remote from the second arm so as to pivot in the plane of the first arm.

Advantageously, said assembly is upwardly inclined with respect to the horizontal from the gripping mechanism.

Further features of the invention will be apparent from the ensuing description with reference to the accompanying drawings which are given solely by way of example and in which.

Figure 1:
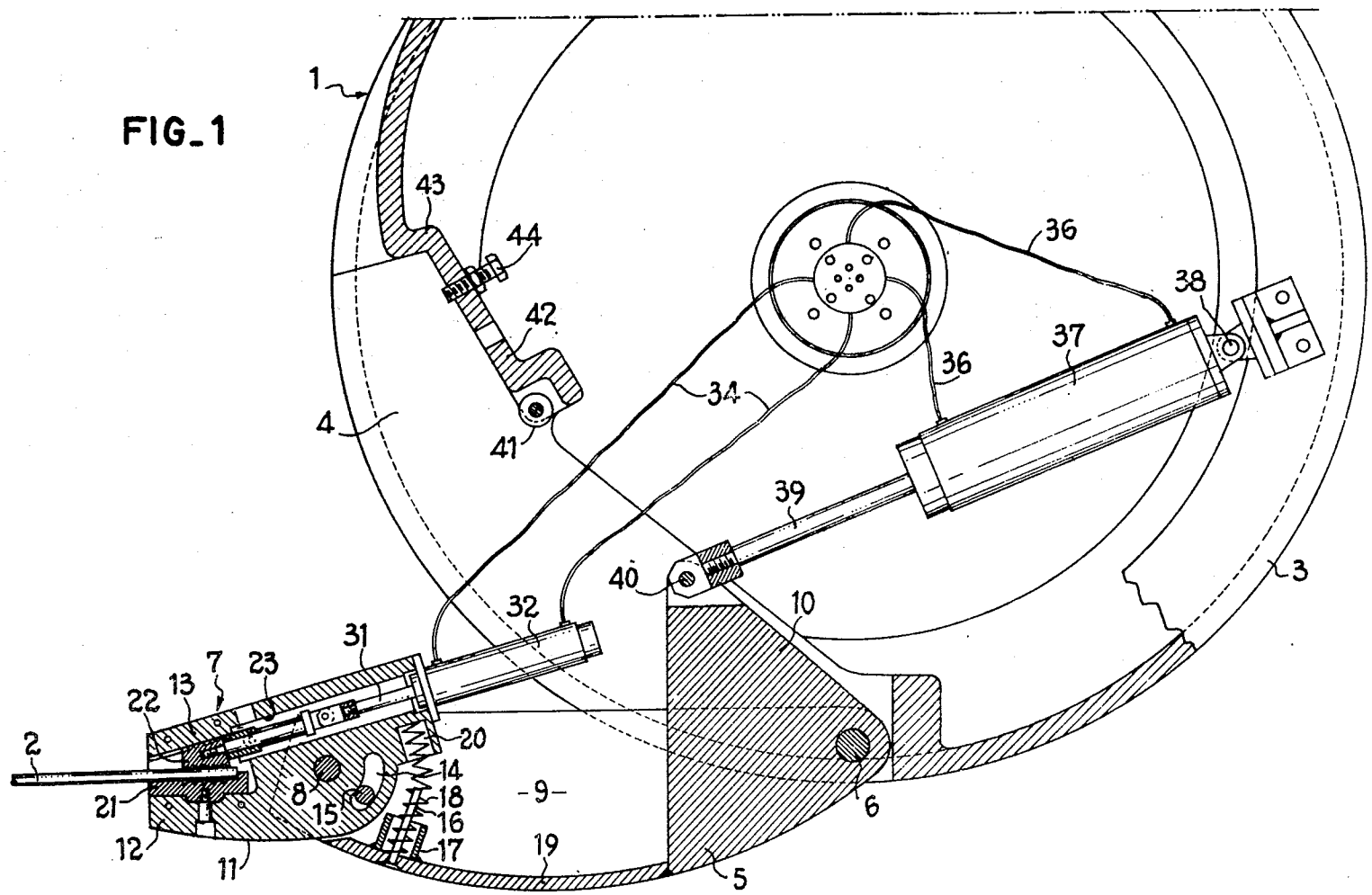
FIG. 1 is a plan view, partly in section, of a winding drum for a drawing bench comprising a drawn product end seizing device according to the invention in the open or extended position relative to the drum, the product end being gripped in the jaws of the gripping mechanism.
Figure 2:
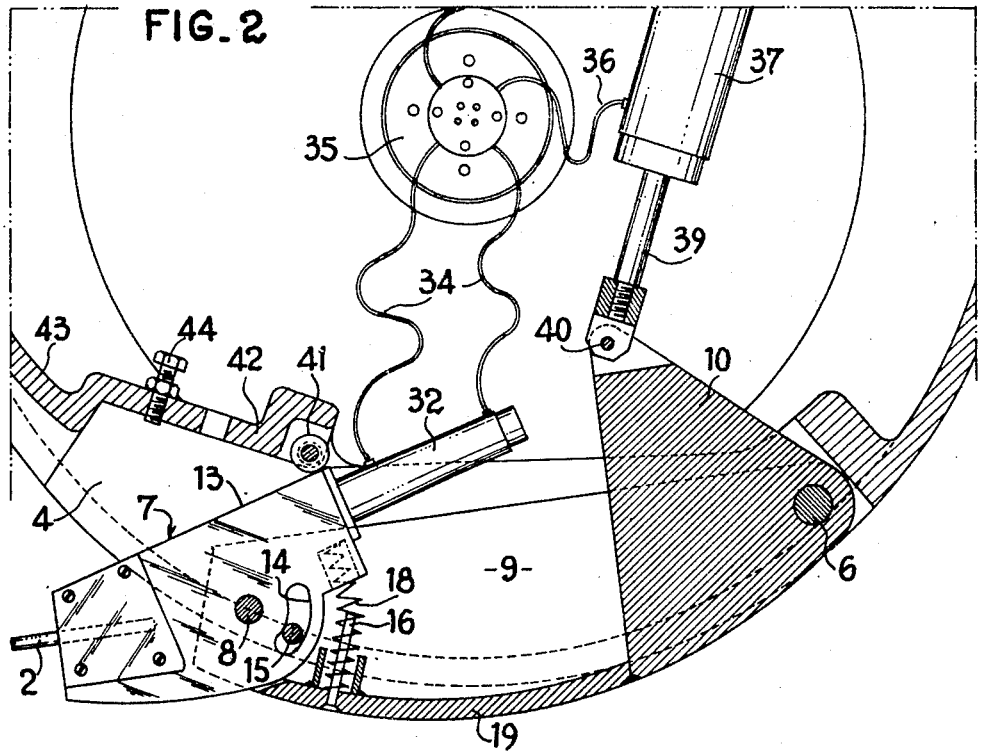
FIG. 2 is a partial plan view of the top of the drum showing the device according to the invention in the first stage of its withdrawal into the drum at the start of the winding operation.
Figure 3:
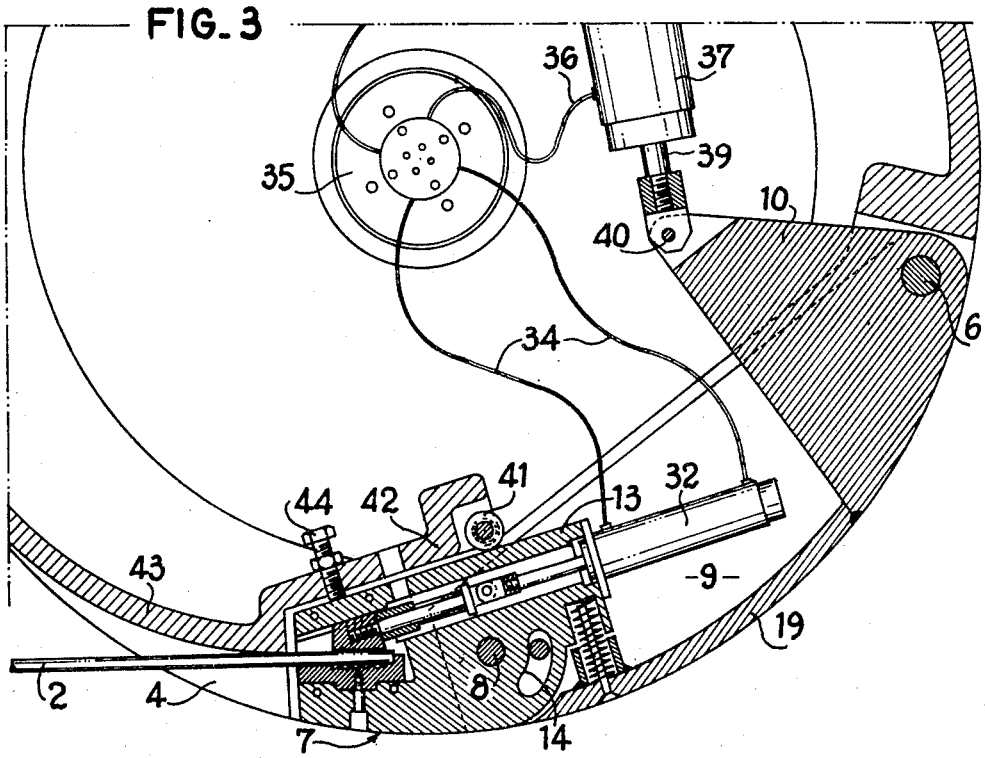
FIG. 3 is a view similar to FIG. 2 of the device in the second stage of its withdrawal at the start of the winding.

With reference to the drawings and more particularly in FIGS. 1–3, the device according to the invention is shown mounted on a drum 1 on which a drawn wire 2 must be wound, the drum being so mounted that the wire outlet axis is roughly tangential to the periphery of the drum when the drum is viewed in plan.

Figure 6:
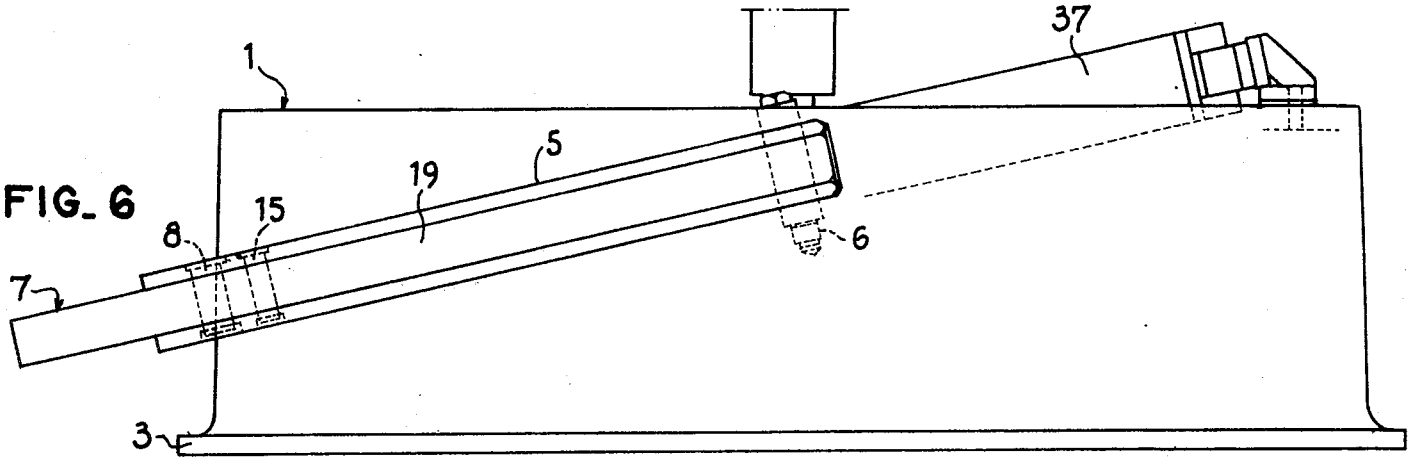
FIG. 6 is a side elevational view of the drum including the device according to the invention in the withdrawn position of the latter and showing the angle at which the winding is effected.

The drumhas a periphery which is slightly upwardly convergent from its lower part which includes a flange 3 (FIG. 6). It has in its wall a cavity 4 of elongated shape extending obliquely from a point located in the vicinity of its upper part toward the flange 3 in forming with the plane containing the latter an angle of about 15° whose apex is located outside the drum in the plane containing the flange 3. The cavity 4 has the general shape of a cylindrical sector defined by a chord of the circumference of the drum.

Disposed in the cavity 4 is the drawn product end seizing device according to the invention. This device comprises a cranked lever 5 which is pivotably mounted on a pin 6, which is oblique with respect to the axis of the drum, in the cavity 4 and a gripping mechanism 7 having self-gripping jaws and which is pivotably mounted by a pin 8 on an end of the cranked lever remote from the pin 6.

For reasons of clarity of the ensuing description the inclination of the cavity 4 and of the seizing device contained therein will be ignored and this device will be described as viewed in plan in FIGS. 1–3.

The cranked lever 5 has an arm 9 of elongated shape which has, in plan, the shape of a cylindrical sector having the same radius as the drum and, in section, the shape of a U whose branches extend roughly horizontally and constitute a fork, and a shorter arm 10.

The cranked lever 5 is pivotably mounted on the pin 6 by its cranked portion, as shown, in the vicinity of the end of the cavity 4 remote from the flange 3, that is to say the higher end.

As can be seen in the drawings, the arms 9 and 10 of the cranked lever 5 and the pin 6 are so arranged that this lever is pivotable between an extended position (FIG. 1), in which it extends out of the drum, and a withdrawn position, in which the curved edge of the fork defined by the arm 9 partially reconstitutes the surface of the drum on about ⅔ of the length of the cavity 4 (FIG. 3), the arm 9 thus forming a part of the drum in this withdrawn position.

The gripping jaw mechanism 7 is pivotably mounted on the pin 8 at the end of the arm 9 between the branches of the fork defined by said arm, the pin 8 being riveted to said branches.

The gripping mechanism comprises a curved outer side or wall 11 (FIG. 1) of such shape that the mechanism 7 is pivotable in the fork and is capable of reconstituting the surface of the drum, when the cranked lever 5 is in its withdrawn position, roughly in the remainder of the length of the cavity 4.

The other sides of the gripping mechanism 7 may have any shape which is complementary to that of the cavity 4 so that this assembly is capable of entering the cavity in the withdrawn position. However, this shape is such that it has a side 12 roughly perpendicular to the periphery of the drum when the gripping mechanism is in the withdrawn position, this side 12 being adjacent a side 13 forming a ramp which is adapted to cooperate with a roller for a purpose which will be described hereinafter.

The mechanism 7 comprises a curved aperture 14 through which extends an abutment pin 15 integral with the branches of the fork, the aperture being centred on the pin 8 so as to limit the pivoting of the mechanism 7 with respect to the fork.

An elastically yieldable device for biasing the mechanism 7 is also provided between the branches of the fork and between the pins 8 and 6 in the vicinity of the aperture 14. This device comprises a finger member 16 disposed in the centre of a spigot 17 which are fixed inside the fork between the branches of the latter. The finger member 16 guides a coil spring 18 which bears at one end against the inner surface of the outer wall 19 of the fork and at its other end in a cavity 20 provided in the vicinity of the end of the body of the mechanism 7. The spring 18 biases the mechanism 7 so as to rotate it about the pin 8 away from the surface of the drum to a position in which it is arrested by the pin 15 which abuts the end of the aperture 14 (FIG. 1).

The gripping mechanism 7 also has a fixed jaw 21 which is roughly perpendicular to the side 12 of the body of the mechanism in an opening provided in this side for the introduction of the drawn product end, and a movable jaw 22 which is slidably mounted in this opening. The movable jaw 22 has the shape of a wedge having a toothed face parallel to a toothed face of the fixed jaw 21 and an apposite face which bears against an inclined surface 23 constituting a ramp which is convergent with respect to the surface of the fixed jaw in the direction of the side 12 of the body of the mechanism 7, the arrangement being such that the movable jaw 22 is capable of being wedged against the fixed jaw 21 when it is shifted along the ramp 23 toward the side 12.

Figure 4:
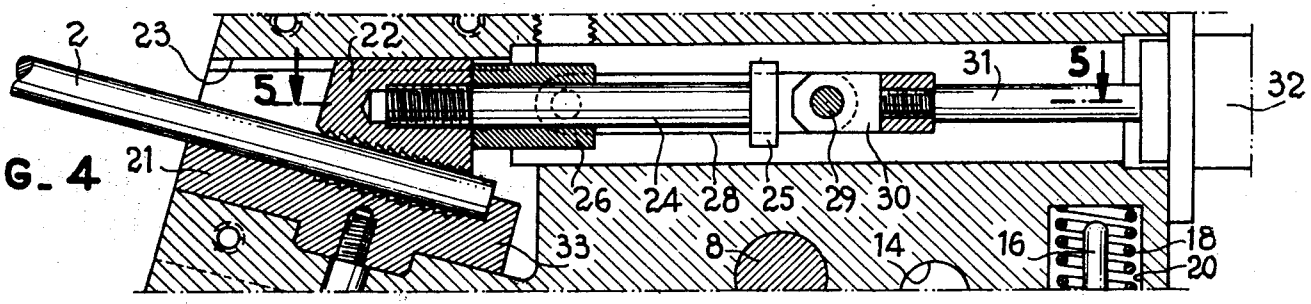
FIG. 4 is a partial sectional view of a device for releasing the product end.
Figure 5:
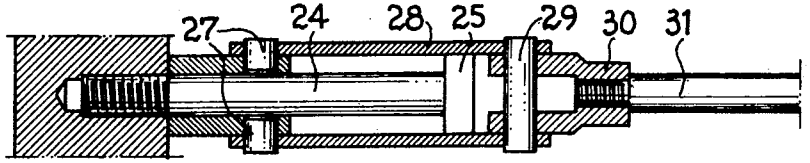
FIG. 5 is a partial sectional view taken on line 5-5 of FIG. 4.

FIG. 4 shows to an enlarged scale the arrangment of the jaws 21, 22 and a mechanism for shifting the movable jaw 22. This mechanism comprises a screw 24 which has a square head 25 and is crewed in the rear part of the jaw 22. A sleeve 26 is slidably mounted on the stem of this screw 24 and has two diametrally opposed apertures in which two bosses 27 (FIG. 5), integral with the branches of a yoke 28, are received, the head 25 of the screw 24 being slidable between these branches. The transverse portion 29 of the yoke is pivotably mounted on a fork 30 which is integral with the piston rod 31 of a double-acting jack 32 whose cylinder is fixed to the body of the mechanism 7.

Preferably, and as shown, the fixed jaw 21 has a shoulder 33 in the vicinity of its rear end, this shoulder constituting an abutment for the drawn product end 2.

The jack 32 is supplied with hydraulic fluid under pressure by way of two flexible pipes 34 which are connected to a rotary joint 35 which is part of a distributing device and is located on the axis of the drum 1.

The rotary joint 35 also ensures by way of flexible pipes 36 the supply of fluid to a double-acting jack 37 whose cylinder is pivoted at 38 inside the drum 1 and whose piston rod 39 is pivoted to the end of the arm 10 of the cranked lever 5 by a pin 40.

It wil be understood that the jack 37 is inclined with respect to the axis of the cylinder in the same way as the cavity 4.

The device according to the invention operates in the following manner:

Let is be assumed that the position shown in FIG. 1 is the starting position in which the device according to the invention is extended in engagement with the drawn product end 2 which is to be wound onto the drum 1. the jack 32 is first actuated so as to withdraw the movable jaw 22. The product end 2 is placed in position on the fixed jaw 21 and the jack 32 is once more actuated in the opposite direction so as to return the movable jaw 22 to a position for wedging the product end 2.

The cylinder of the jack 37 is then connected to the exhaust and the drum1 is rotated in the required direction for winding the drawn product.

A pull on the product end 2 tends to progressively jam the movable jaw 22 owing to the arrangement thereof. The drum then starts to rotate and, owing to the roughly tangential position of the product end 2 roughly in alignment with the pins 8 and 6, the cranked lever 5 tends to re-enter the cavity 4 under the effect of the pull on the product end 2. The gripping mechanism 7 is still maintained in an extended position by the pull exerted on the end 2 of the drawn product. The gripping mechanism 7 is swung inwardly by pivoting with respect to the arm 9 of the lever 5 under the action of the pull exerted on the end 2 owing to rotation of the drum, until it reaches its completely withdrawn position.

As the drum continues to rotate, the ramp 13 moves against the roller 42 which rolls therealong and urges back the mechanism 7, in opposition to the action of the spring 18, by making it rotate about the pin 8 to the position shown in FIG. 3 in which the arm 9 and the gripping mechanism 7 are completely withdrawn in the cavity 4. The side 19 of the arm 9 and the side 11 of the mechanism 7 which have the same radius as the dum re-constitute the peripheral surface of the drum substantially throughout the extent of the cavity 4.

Advantageously, the support 42 is constituted by the extension of a portion 43 of the wall of the drum which is curved inwardly and may have an adjustable abutment screw 44 whereby it is possible to adjust the final position of the gripping mechanism 7 with precision (FIG. 3).

As the drum continues to rotate, the product end 2 bears against the portion 43 and starts to be wound onto the drum.

It will be observed that, owing to the inclination to the horizontal of the device according to the invention, each coil wound onto the drum is formed a little above the flange 3, that is to say on the part of the drum which has the largest diameter. As this diameter decreases toward the top end of the drum, this coil tends to shift upwardly on the drum and each of the following coils is formed just below the preceding coil.

When it is desired to release the seized drawn product end, the jack 32 is actuated in the desired direction to advance the movable jaw 22 but with a very low pressure so as to merely bring the sleeve 26 into abutment with the jaw 22. The jack 32 is thereafter supplied with fluid in the opposite direction with maximum pressure. the piston connected to the yoke 28 returns suddenly rearwardly and drives the sleeve 26 which clides along the stem of the screw 24 and strikes the head 25 of the screw and causes the wedge-shaped jaw 22 to slike rearwardly. As the drawn product end 2 is maintained axially in abutment against the shoulder 33, the jaw 22 is easily disengaged from this end.

It will be observed that this mechanism having a lost motion permits the seizing of a drawn product end of any diameter, compatible with the available distance between the jaws, without adjustment.

The jack 37 is employed to block the lever 5 in its position of maximum opening and to return the device to the withdrawn position in the cavity 4 or, on the contrary, to shift the device out of the cavity before seizing a drawn product end.

If this product end is suitably guided at the output end of the drawing bench, it is possible, for automatically seizing the product end, to deploy the device by means of the jack 37, open the jaws by means of the jack 32 and shift the drum slightly rearwardly to engage the gripping mechanism 7 on the product end.

If desired, there may be provided in the gripping mechanism hydraulic, electrical, mechanical or other means for automatically actuating the jack 37 after the introduction of the drawn product end between the jaws of the gripping mechanism.

These means are conventional and well known and need not be described in more detail.

The device according to the invention is particularly adapted to be employed in a drawing bench between a drawing die and the various appropriate devices for straightening, polishing and sectioning, etc . . . the drawn product.

The movement of the arm 5 toward the exterior, the actuation of the jack, the release of the drawn product end and the rotation of the drum in either direction may be brought about by suitable means the action of which is controlled by a program.

It will be understood that when a certain number of coils have been formed on the drum, the drawn product end is released for the engagement thereof in the following devices.

The jack 37 is actuated to return the gripping mechanism into the cavity 4 in the withdrawn position when a drawn product end is not engaged between the jaws.

As the gripping mechanism 7 is always maintained in an extended position by the action of the spring 18, the ramp 13 extends obliquely toward the centre of the drum.

For the purpose of bringing the gripping mechanism 7 inwardly by rotating it with respect to the arm 9 of the lever 5, there is provided a roller 41 which is freely rotatable on a support 42 in a suitable position for coming in contact with the ramp 13 of the mechanism 7 as shown in FIG. 2.

Having now described our invention what we claim as new and desire to secure by Letters Patent is:

1. A device for automatically seizing a drawn product end for a drum of a drawing bench, the device comprising said drum which has a peripheral wall and is rotatable about an axis, means defining a cavity in the drum wall, an elongated element pivotably mounted in the cavity and having a shape substantially corresponding to the shape of the cavity and constituting a movable portion of the drum wall and pivotable between an extended position and a withdrawn position in which withdrawn position said element is returned into said cavity so as to substantially reconstitute the wall of the drum, a gripping mechanism for gripping said product end and pivotably mounted on said element, the gripping mechanism being adapted to be substantially in alignment with said product end in said extended position of said element, said cavity being upwardly inclined in the wall of the drum, with respect to the direction of rotation of the drum, from a lower edge of the drum, said element being a cranked lever having a first arm which extends inwardly of the drum and a second arm which has an elongated shape substantially corresponding to the shape of said cavity and has a U-shaped cross-section and constitutes a fork comprising two branches and an intermediate portion which closes said cavity in said withdrawn position, said lever being pivotably mounted by a cranked portion thereof intermediate said arms in an upper end of the cavity and pivotable about an axis which is oblique with respect to said axis of the drum, the gripping mechanism being mounted between said branches of the fork at an end of the second arm remote from the first arm to pivot in the plane of the second arm.

2. A device as claimed in claim 1, wherein the gripping mechanism is of the self-gripping type and comprises means defining an inclined ramp, a fixed jaw fixed relative to the ramp, a wedge-shaped movable jaw slidable on the inclined ramp, a double-acting jack and a lost-motion device connecting the double-acting jack to the movable jaw.

3. A device as claimed in claim 2, comprising elastically yieldable means and abutment means interposed between the fork and the gripping mechanism so as to respectively bias the gripping mechanism to a position in which it extends from the drum and to limit the pivoting of the gripping mechanism relative to said element, a rotary abutment provided in said cavity for cooperation with said means defining the ramp for pivoting said mechanism inwardly of the drum when said lever is withdrawn into said cavity.

4. A device as claimed in claim 1, comprising a double-acting jack pivotably mounted at one end thereof inside the drum and pivotably mounted at an opposite end of the double-acting jack on the first arm of said cranked lever.

5. A device as claimed in claim 2, wherein the lost-motion device comprises a piston rod of the jack, a fork integral with the piston rod of the jack, a yoke pivotably mounted on the fork, a rod integral with the movable jaw and having an end defining an abutment, and a sleeve slidable on the rod between the movable jaw and said abutment, the yoke having branches which are pivoted to the sleeve.

6. A device as claimed in claim 2, wherein said jack is supplied with fluid by a device comprising a rotary joint on said axis of the drum.

7. A device as claimed in claim 4, wherein said jack is supplied with fluid by a device comprising a rotary joint on said axis of the drum.

8. A device as claimed in claim 2, wherein the fixed jaw comprises an abutment for stopping the drawn product end.

9. A device as claimed in claim 3, wherein the wall of the drum has a portion which is inwardly curved and extends into said cavity to constitute a support for said rotary abutment, an adjustable fixed abutment which is cooperative with the means defining the ramp being mounted on said inwardly curved portion of the wall of the drum.

10. A device as claimed in claim 1, wherein the axis about which the cranked lever is pivotable in the cavity is inclined with respect to said axis of the drum substantially at an angle of 15°.

11. A device as claimed in claim 2, further comprising a second double-acting jack which is pivotably mounted at one end thereof inside the drum and pivotably mounted at an opposite end thereof on said first arm of said cranked lever, and means for automatically controlling the two jacks.

* * * * *